US008333094B2

(12) United States Patent
Wolf

(10) Patent No.: US 8,333,094 B2
(45) Date of Patent: Dec. 18, 2012

(54) ARRANGEMENT FOR BENDING TUBULAR WORKPIECES

(75) Inventor: Jürgen Wolf, Wälddorfhäslach (DE)

(73) Assignee: Wafios Aktiengesellschaft, Reutlingen (DE)

( * ) Notice: Subject to any disclaimer, the term of this patent is extended or adjusted under 35 U.S.C. 154(b) by 146 days.

(21) Appl. No.: 12/842,463

(22) Filed: Jul. 23, 2010

(65) Prior Publication Data

US 2011/0016941 A1 Jan. 27, 2011

(30) Foreign Application Priority Data

Jul. 24, 2009 (DE) ..... 10 2009 034 589

(51) Int. Cl.
*B21D 7/04* (2006.01)

(52) U.S. Cl. ..... 72/149; 72/707; 72/430; 72/283; 72/466.2; 72/387

(58) Field of Classification Search ..... 72/430, 72/707, 149, 150, 154, 283, 369, 466.2, 387
See application file for complete search history.

(56) References Cited

U.S. PATENT DOCUMENTS

| | | | | |
|---|---|---|---|---|
| 2,957,511 | A * | 10/1960 | Reif | 72/382 |
| 3,147,792 | A | 9/1964 | Hautau | |
| 3,473,361 | A | 10/1969 | Cwik | |
| 3,705,506 | A * | 12/1972 | Clavin et al. | 72/20.1 |
| 3,891,953 | A | 6/1975 | Thomin | |
| 4,232,813 | A | 11/1980 | Eaton | |
| 4,856,703 | A | 8/1989 | Uhlmann | |
| 6,253,595 | B1 * | 7/2001 | Lewis, Jr. | 72/369 |
| 6,526,793 | B1 * | 3/2003 | Danko et al. | 72/17.1 |
| 2009/0007620 | A1 * | 1/2009 | Spath | 72/369 |
| 2010/0218580 | A1 * | 9/2010 | Tomizawa et al. | 72/342.94 |

FOREIGN PATENT DOCUMENTS

| | | |
|---|---|---|
| DE | 37 39 730 | 1/1988 |
| DE | 28 16 840 | 10/1988 |
| EP | 1 484 123 B1 | 11/2006 |

* cited by examiner

*Primary Examiner* — Bena Miller
(74) *Attorney, Agent, or Firm* — Patterson Thuente Christensen Pedersen, P.A.

(57) ABSTRACT

In an arrangement for bending tubular workpieces, in which a workpiece is supplied to a bending head for bending and is supported from the inside during the bending process in the bending region by means of a mandrel introduced into the workpiece, with the mandrel comprising a mandrel element and a traveler, sitting movably in the workpiece and the traveler being longitudinally displaceable in the workpiece by means of a feed device (14), the traveler is produced from a magnetizable material and the feed device comprises a magnetic device which is applied to a position corresponding to the position of the traveler outside of the workpiece, with a positive magnetic engagement being formed between the magnetic device and the traveler, with the traveler being displaceable in the workpiece via the magnetic device.

13 Claims, 3 Drawing Sheets

ARRANGEMENT FOR BENDING TUBULAR WORKPIECES

This application claims priority to German Patent Application No. 10 2009 034 589.2 filed on Jul. 24, 2009, which is incorporated herein by reference in its entirety.

FIELD OF THE INVENTION

The invention relates to an arrangement for bending tubular workpieces, in which a workpiece is supplied to a bending head for bending and is supported from the inside during the bending process in the bending region by means of a mandrel.

BACKGROUND OF THE INVENTION

It has long been known to perform pipe bending with highly flexible, CNC-controlled bending machines, with measures being used which support the material properties in the limit areas in order to achieve reproducible bending results without any material failure. Such supporting measures include the use of internal mandrels, slide rails or fold smoothers, with the use of internal mandrels in a pipe bending machine being used especially for internal support of the pipe during the bending in the bending area. This should prevent that undesirable deformations, fissures, folds or the like occur in the pipe during bending.

The internal mandrel device usually consists of a mandrel element which is fastened to a mandrel bar which on its part connects the mandrel element with a traveler which is connected to a feed device in order to axially displace the mandrel element in the pipe. This known method usually only works with pipes which have been cut to respective lengths and are supplied to the bending machine successively. After the insertion of the workpiece, the internal mandrel is inserted into the pipe from behind and positioned in the bending region. The feed device is attached axially behind the pipe.

It is often desirable in the area of small diameters to process endless pipe material from the coil. In this case however it is no longer possible to insert an internal mandrel from the end of the pipe, so that in this case it is necessary to bend without the internal mandrel. This leads to the consequence however that desired bends with narrow bending radii can often not be produced.

It is also often the case that very long workpieces that are cut to size are available which cannot be processed with internal mandrels on conventional machines, but which require special longer machine assemblies or need to be shortened to a respective length, leading to a high amount of waste however.

Such machines are also known which work directly out of the sheet material, form the same at first into a pipe and then bend it. The internal mandrel is inserted into the pipe region that has not yet been closed.

The use of ice as the material for an internal mandrel is further known.

The use of floating mandrels during pipe drawing is also known in the state of the art.

EP 1 484 123 B1 describes a machine in which a pipe is formed from a sheet which is subsequently formed by bending. The mandrel unit is arranged to be offset to the rear to such an extent that it engages from above into the still open profile and thus positions the mandrel element in the bending area. This known method does not work in the case of profiles that have already been closed such as finished pipes.

An apparatus is known from DE 28 16 840 in which a pipe is formed from a sheet which is formed again subsequently by bending. It is proposed here to use a frozen or solidifiable material (ice) for the internal mandrel. The use of fluids or other solidifiable materials is actually undesirable, is not suitable for all pipe materials and is also unable to withstand the high pressures during bending.

U.S. Pat. No. 3,891,952 describes an apparatus for producing fins on pipes by rollers. An internal mandrel is inserted into the pipe as a counterholder against the roller pressure, which mandrel is axially fixed in a respective position via an external magnet. The internal mandrel is not used in conjunction with bending machines.

The same also applies to the pipe drawing apparatus of DE 37 39 730 C1 where a magnetically held mandrel is used during pipe drawing. It does not concern an internal mandrel for bending machines however.

There is a need to provide an arrangement for bending tubular workpieces of the kind mentioned above, with which pipes of any desired length, which also include endless pipes from the coil or pipes tapering on one side or formed in another way and which prevent the insertion of the internal mandrel from behind, can be bent with an internal mandrel without limiting the use of the internal mandrel device by the length of the workpiece or the length of the machine.

SUMMARY OF THE INVENTION

An apparatus and method for bending tubular workpieces, in which a workpiece is supplied to a bending head for bending and is supported from the inside during the bending process in the bending region by means of a mandrel introduced into the workpiece, with the mandrel comprising a mandrel element and a traveler, sitting movably in the workpiece and the traveler being longitudinally displaceable in the workpiece by means of a feed device.

In an embodiment of the invention, the traveler consists of a magnetizable material and the feed device comprises a magnetic device which is attached in a position corresponding to the position of the traveler outside of the workpiece, with a positive magnetic engagement being formed between the magnetic device and the traveler, with the traveler being displaceable in the workpiece via the magnetic device. Both the traveler and the magnetic device consist of a permanent magnet arrangement. The term "magnetizable material" includes such an arrangement.

In accordance with an embodiment of the invention, the feed device is no longer attached axially behind the workpiece (pipe), as was the case previously, but lies outside of the workpiece in a position corresponding to the position of the traveler. The positive magnetic engagement thus created in accordance with the invention between the magnetic device and the traveler now offers the possibility of producing a contactless displacement of the traveler within the workpiece by a respective change of the magnetic field in the magnetic device, e.g. by a movement of the same in the longitudinal direction of the workpiece or also by generating a travelling magnetic field in the axial direction of the workpiece. It is thus possible to bend endless pipes drawn from the coil as well as very long pipes cut to size, or also other pipes where an insertion of the mandrel from behind is impossible with an internal mandrel nevertheless. At the same time, a very compact configuration of the arrangement in accordance with the invention is obtained which is also exceptionally effective and operationally reliable.

The arrangement in accordance with the invention further has a surprisingly simple configuration, is hardly susceptible to malfunctions, works with very good efficiency and can be produced and used at low cost.

In an embodiment of the invention, the magnetic device is attached to be displaceable in the longitudinal direction, for which purpose it is preferably connected to a drive, e.g. a pneumatic cylinder, a spindle drive or the like. When the actuating device is thus displaced in the longitudinal direction of the workpiece, the positive magnetic engagement between the magnetic device and the traveler ensures that the traveler will also be displaced, which is then also disposed in the interior of the pipe and is fixed by the positive magnetic engagement in relation to the magnetic device.

In an embodiment of the invention, the magnetic device is arranged in the invention about the outside circumference of the tubular workpiece. It advantageously consists of two halves which enclose the tubular workpiece in the assembled state and are fastened to one another in a detachable way, and whose separation areas lie in a diametric plane of the workpiece. In order to remove the magnetic force during the insertion of the mandrel element into the pipe, the two halves of the magnetic device can be moved away from one another in this embodiment, through which the introduction of the traveler and the mandrel element into the tube can be readily accomplished.

An embodiment of the invention has the arrangement of magnets and the traveler made of layers of permanent magnets which are axially separated from one another by spacers made of a non-magnetizable material, with their axially facing sides having the same polarity. In an embodiment, the permanent magnets of the traveler have mutually opposing magnetic poles in comparison with those permanent magnets which are associated with them on the outside of the workpiece, as seen in the axial direction of the workpiece.

In this way, several magnets may be arranged behind one another according to the required feed force for the traveler, with the same pole being provided at the left and right end of the traveler, so that the direction of the traveler no longer plays any role when it is inserted into the pipe. This may be achieved by way of the traveler and the magnetic device each comprising an even number of permanent magnets along the longitudinal axis of the workpiece, which then ensure that the poles of the first and the last magnet are the same poles.

In an embodiment of the invention, the magnetic device can also be arranged as an electromagnet. In this respect, the magnetic device is arranged in such a way that a travelling magnetic field is produced in the axial direction of the workpiece, by which the traveler can be displaced in the longitudinal direction by operating as a linear motor without then having to displace the magnetic device on its part. In this case, the magnetic device must be arranged to be considerably longer than the traveler, as seen in the axial direction of the workpiece. The advantage of such a configuration is that no further drive apparatuses for displacing the arrangement of magnets are required and the traveler can be used in a highly unproblematic way when the magnetic field is switched off.

In another embodiment of the invention, the traveler is connected with the mandrel element via a mandrel bar. An advantage is that the mandrel element can then be moved in the workpiece during the bending process in a reversing manner and/or rotating about its longitudinal axis, which can be easily achieved in the arrangement of the magnetic device as an electromotor by respective control of the same. As a result, the interior mandrel element is not positioned at a specific position in the bending area during the bending process, but can be moved in a reversing manner (e.g. oscillating or swinging) in the bending area and/or rotating about its longitudinal axis. Such oscillating motions can be operated with a low frequency (e.g. in order to post-form the bend with a section-type mandrel) or with a high frequency (e.g. for reducing the friction between the internal mandrel and the pipe, for acting in a hammering manner on the bending area or also for influencing the flow behavior of the pipe material).

In the case of a coaxial arrangement of traveler and magnetic device, the radial gap is advantageously chosen to be so small between the two in the invention that the workpiece can just about be displaced through the same, since the gap between traveler and magnetic device should be as small as possible between traveler and magnetic device in the interest of the largest possible transmission of forces, which is why efforts are made to keep the same as small as possible. It should still be so large however that the workpiece to be processed should still be freely displaceable through the formed gap.

Principally it needs to be noted that the especially noteworthy advantage in particular embodiments is achieved in the invention that no mechanical connection is required any longer (and does not exist) between the internal mandrel (with the mandrel element and the traveler) and the magnetic device.

DESCRIPTION OF THE FIGURES

The invention is now principally explained in closer detail by way of example by reference to the drawings, wherein.

DETAILED DESCRIPTION

Figure 1:
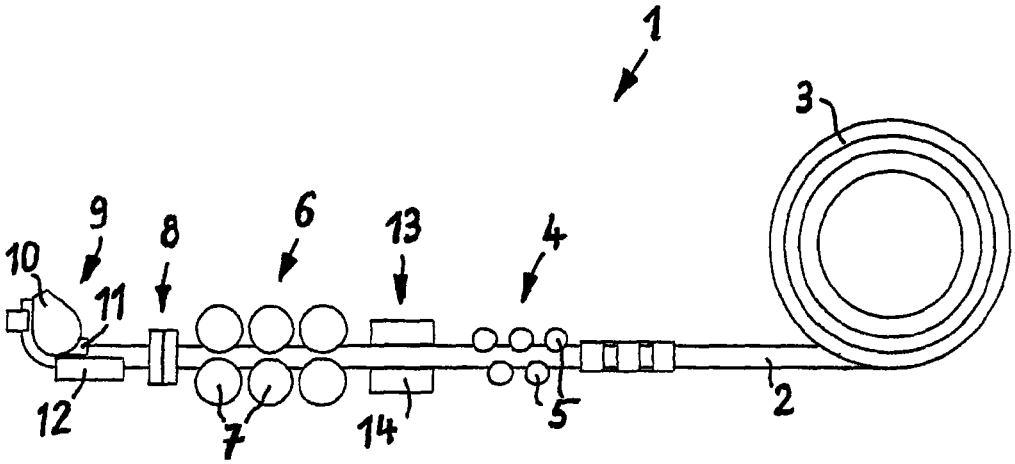
FIG. 1 shows a schematic principal top view of a bending machine provided with an internal mandrel arrangement in accordance with the invention.

FIG. 1 shows in a top view a schematic illustration of a bending machine 1 for bending a tubular workpiece 2 in the form of an endless pipe material from coil 3. The illustrated bending machine 1 comprises a straightening unit 4 with several straightening rollers 5 located in different planes and a feed unit 6 with several infeed rollers 7, a severing device 8 for cutting off the endless tubular workpiece 2, and a bending die 9 with a bending mandrel 10, a fold smoother 11 and a slide rail 12.

It would also be possible to use a linear infeed with movable gripper units, a displaceable collet or the like instead of the illustrated feed unit 6.

The arrangement of the bending machine 1 thus shown concerns a standard arrangement by way of example.

In this case however, a contactless working internal mandrel device 13 is now provided in the interior of the tubular workpiece 2. FIG. 1 only shows the actuating device in the form of a magnetic device 14 which is arranged about the tubular workpiece 2. The internal mandrel device 13 can principally be attached at any desired position along the tubular workpiece 2 between the coil 3 and the bending die 9, which means also between the feed device 6 and the bending die 9 for example.

Figure 2:
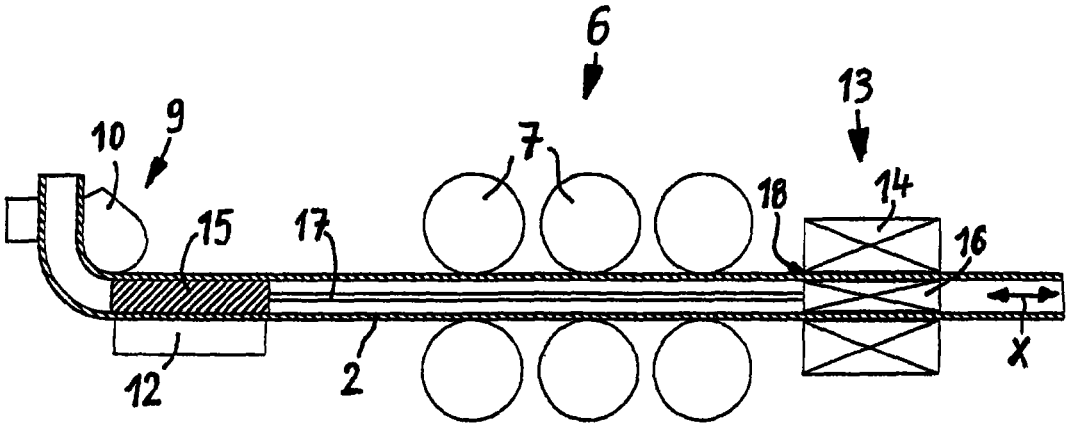
FIG. 2 shows a schematic and enlarged detailed illustration of the view of FIG. 1, but in a partly sectional view of the bending machine shown there.

FIG. 2 now shows a slightly enlarged, partly sectional detail of FIG. 1. In addition to the bending die 9 and the feed unit 6, one can recognize the entire internal mandrel device 13.

The magnetic device 14 allows a displacement of the mandrel element 15 which is applied in a displaceable manner in the tubular workpiece 2, as will be explained below in closer detail, which mandrel element is arranged in the form of a stub mandrel, a section-type mandrel, a spherical mandrel, a spoon-type mandrel, a special mandrel or the like and is connected with a traveler 16 via a mandrel bar 17.

Traveler 16 can be displaced in the axial direction X in the tubular workpiece 2 via the magnetic device. The traveler 16 and the magnetic device 14 are arranged in such a way that in the case of a coaxial arrangement of the two the tubular workpiece 2 to be processed can just about be slid through the remaining radial gap 18. The gap 18 between the traveler 16 and the magnetic device 14 should be as small as possible in the interest of good and high transmission of forces. The internal mandrel can also be arranged without a mandrel bar 17 when the magnetic device 14 is provided directly behind the bending die 9. In this case, the mandrel element 15 can converge directly into the traveler 16.

Figure 3:
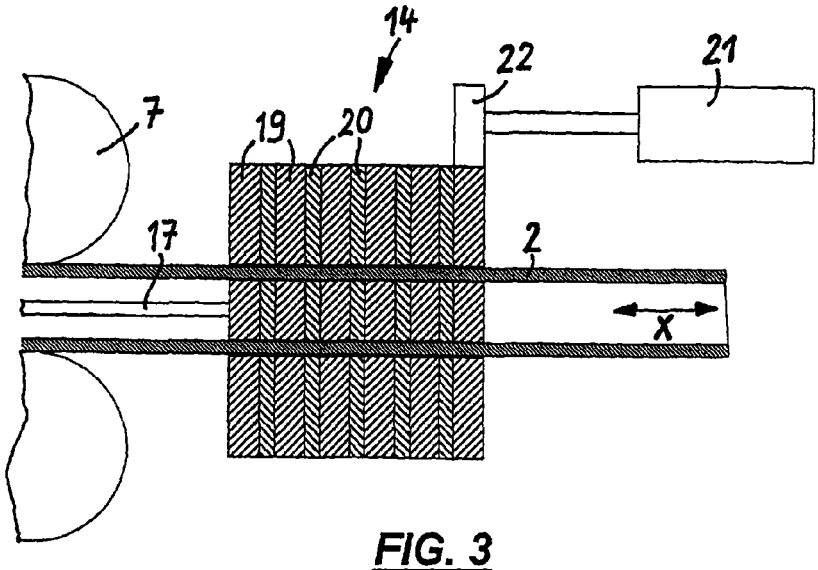
FIG. 3 shows a first embodiment of magnetic device and traveler in the form of permanent magnets.

Reference is now made to FIG. 3, in which a first embodiment of the magnetic device 14 and traveler 16 is shown in an arrangement in accordance with the invention.

In this embodiment, both the traveler 16 and the magnetic device 14 are provided with several permanent magnets 19 which are stacked adjacent to one another in the axial direction X, with spacers 20 made of a non-magnetizable material being provided between the individual permanent magnets 19. When the internal mandrel has been inserted, traveler 16 is fixed by the magnetic device 14 in the axial direction X. In order to displace the same, and thus the internal mandrel, a drive 21 is provided in the form of a pneumatic cylinder for example, a spindle drive or the like, which is connected with a coupling point 22 to the magnetic device 14. The magnetic device can be displaced in the axial direction X by the drive 21, through which the traveler 16 which is disposed in the interior of the tubular workpiece 2 (and the entire internal mandrel with the same) can be displaced as a result of the magnetic flux.

This configuration allows a very compact arrangement of the magnetic device 14, but requires a separate drive device 21 and special precautions for inserting the internal mandrel because the magnetic force cannot be switched off.

Figure 4:
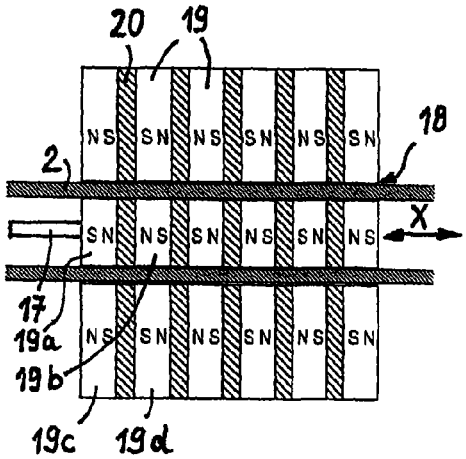
FIG. 4 shows an arrangement of the magnetic device in the illustration according to FIG. 3.

The arrangement of the polarity (north/south) of the permanent magnets 19 is shown in FIG. 4. The traveler 16 consists of a first magnet 19*a* which has a south pole on the left and a north pole on the right. This is followed by a spacer 20 and the second magnet 19*b*, but with its north pole to the left and the south pole to the right. Several permanent magnets 19 can be arranged axially behind one another in a stacked manner depending on the required feed force. Ideally, the same pole is at the left and right end of the traveler 16, so that the direction of the traveler 16 does not play any role during the insertion into the tubular workpiece 2. The permanent magnets 19*c*, 19*d*, etc. of the magnetic device 14 are in principle arranged identically as in traveler 16, with the position of the poles being exchanged in relation to the traveler 16, as is shown in FIG. 4, and to which reference is hereby made.

Figure 5:
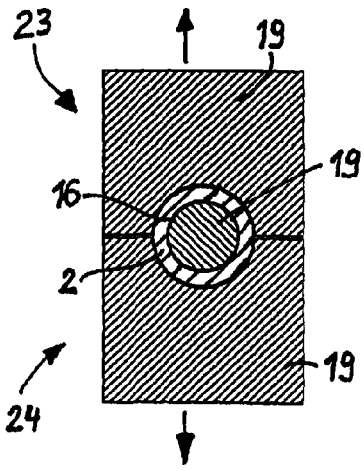
FIG. 5 shows a front view of the internal mandrel device according to FIG. 3.

FIG. 5 shows a possible arrangement for inserting the traveler 16 into the tubular workpiece 2 in a view parallel to the axial direction X. It can be seen that the magnetic device 14 consists of an upper half 23 and a bottom half 24 which can be moved away from one another for removing the magnetic force (see directions of arrows), so that the internal mandrel can be introduced into the tubular workpiece 2.

Figure 6:
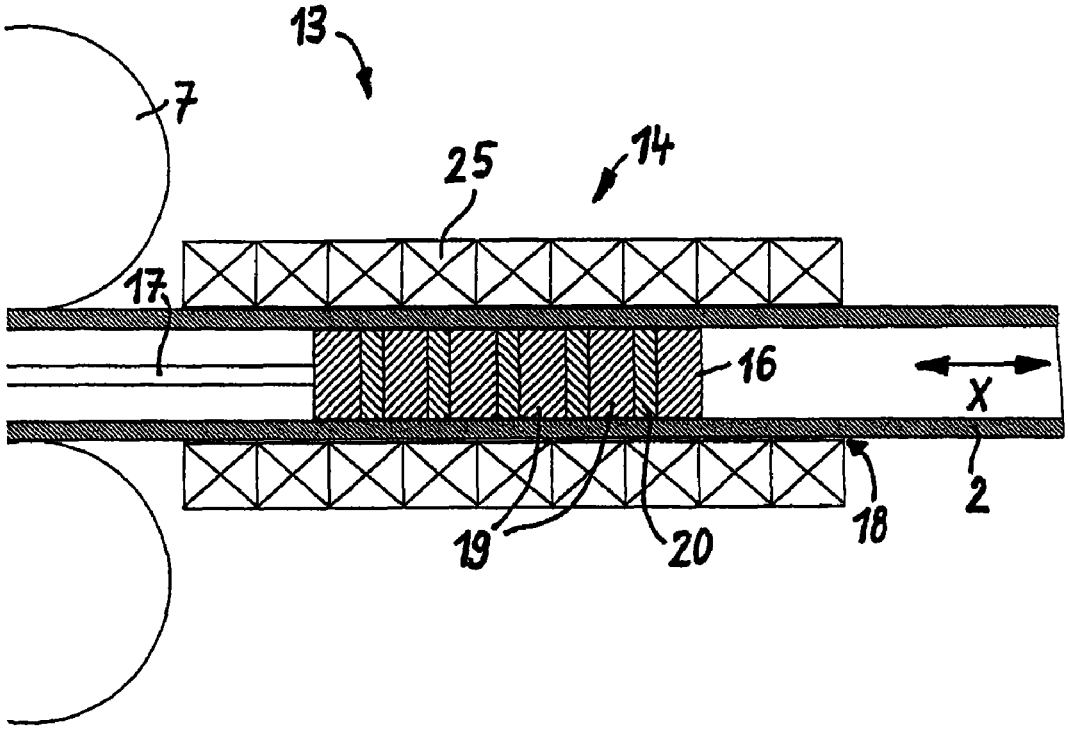
FIG. 6 shows a second embodiment of the internal mandrel device.

FIG. 6 shows a slightly different arrangement of the internal mandrel device 13 and the magnetic device 14.

The internal mandrel device 13 is arranged in this embodiment as a linear motor. Windings 25 are provided in the magnetic device 14, by means of which a travelling magnetic field can be produced in the axial direction X. The traveler 16 is provided with permanent magnets 19, as in the preceding embodiment, but is now displaced no longer by a moved magnetic device 14 but by the travelling magnetic field in the axial direction X. The advantage of such an arrangement is that no further drive apparatus is required any more for displacing the magnetic device 14 and the traveler 16 can be inserted at any time easily into the tubular workpiece 2 when the magnetic field is switched off. This arrangement requires a considerable larger amount of space for achieving the same feed force as in the preceding embodiment.

It is easily also possible to carry out a combination of the two mentioned solutions, in that e.g. the electromagnet of the magnetic device 14, as shown in FIG. 6, can be displaced additionally via a drive (not shown) in the axial direction X ("displaceable electromagnet"), as is shown in the magnetic device 14 according to FIG. 3.

The function of the embodiments as shown in the drawings is the following:

For the purpose of bending a tubular workpiece 2 from the coil 3 with an internal mandrel device 13, the coil 3 is made available on a reel behind the bending machine 1 and is placed in the bending machine 1 between the infeed rollers 7.

Before the first bending process, the internal mandrel (mandrel element 15, mandrel bar 17 and traveler 16) is slid from the front into the tubular workpiece 2 until the traveler 16 is located in the region of the magnetic device 14. For this purpose, either the electromagnet 25 is switched off or the halves 23, 24 of the magnetic device 14 are moved apart, as is shown in FIG. 5 by the arrows.

After the positioning of the internal mandrel in the tubular workpiece 2, the halves 23, 24 of the magnetic device are moved towards one another and the electromagnet 25 is activated and the internal mandrel is thus fixed. Once the bending process starts, the internal mandrel is advanced or retracted in the axial direction X via the magnetic device 14. In order to sever the tubular workpiece 2, the internal mandrel must be retracted to such an extent that the moved cutting knife of severing device 8 is unable to collide with the mandrel element 15.

The mandrel element 15 can support the tubular workpiece 2 in the counter-knife from the inside in order to keep deformations to a low level.

It has proven to be especially advantageous when the internal mandrel is not positioned and does not remain at a certain point in the bending area during the bending process but moves in a reversing (oscillating or swinging) manner in the bending area and/or rotates about its longitudinal axis. This oscillating motion can be operated with a low frequency (e.g. in order to post-form the bend with a section-type mandrel) or with a high frequency (e.g. for reducing the friction between the internal mandrel and the pipe, for acting in a hammering manner on the bending area or for influencing the flow behavior of the pipe material). An especially even wear and tear on the mandrel can be achieved by the rotation.

The arrangement in accordance with the invention allows the easy bending of long and endless pipes with an internal mandrel, thus extending the bendable area for endless pipes. The use of the internal mandrel device is limited neither by the length of the workpiece, nor by the length of the machine.

There is no mechanical connection between internal mandrel and magnet device, thus simplifying the overall configuration considerably and contributing to a high functional reliability.

Although the description above contains many specificities, these should not be construed as limiting the scope of the invention but merely as providing illustrations of some of the presently preferred embodiments of the invention. Thus, the scope of the invention should be determined by the appended claims and their legal equivalents, rather than by the examples given.

The invention claimed is:

1. An apparatus for bending tubular workpieces, the apparatus comprising:

a bending head to which a workpiece is supplied;

a mandrel positionable within the workpiece and movable therein, the mandrel for supporting the workpiece during the bending process, the mandrel comprising a mandrel element and a traveler associated therewith, the traveler comprising magnetic material; and a magnetic device for longitudinally displacing the mandrel within the workpiece, the magnetic device positionable outside the workpiece corresponding to a position of the traveler, the magnetic device and traveler having a positive magnetic engagement formed therebetween, the traveler and associated mandrel being displaceable in the workpiece via the magnetic device.

2. The apparatus according to claim 1, wherein at least one of the traveler and the magnetic device comprises a permanent magnet arrangement.

3. The apparatus according to claim 1, wherein the magnetic device is a permanent magnet arrangement which is applied in a displaceable manner in the longitudinal direction of the workpiece.

4. The apparatus according to claim 1, wherein the magnetic device is arranged about an outside circumference of the tubular workpiece.

5. The apparatus according to claim 4, wherein the arrangement of magnets consists of two halves which extend around the tubular workpiece in the assembled state and are fastened to one another in a detachable way, and whose separation areas are disposed in a diametric plane of the workpiece.

6. The apparatus according claim 2, wherein in the longitudinal direction of the tubular workpiece the arrangement of magnets and the traveler are made of layers of permanent magnets which are axially separated from one another by spacers, with their axially facing sides having the same polarity.

7. The apparatus according to claim 6, wherein both the traveler and the magnetic device comprise respective permanent magnet arrangements and wherein the permanent magnets of the traveler have mutually opposing magnetic poles in comparison with permanent magnets of the magnetic device which are associated with them on the outside of the workpiece, with respect to the axial direction of the workpiece.

8. The apparatus according to claim 7, wherein the traveler and the magnetic device each comprise an even number of permanent magnets along the longitudinal axis of the workpiece.

9. The apparatus according to claim 1, wherein the magnetic device is arranged as an electromagnet.

10. The apparatus according to claim 9, wherein a travelling field can be generated in the magnetic device movable in at least one of axially or rotationally with respect to the workpiece , by means of which the traveler (16) is displaceable in the workpiece with respect to the at least one of the axial or rotational travelling field.

11. The apparatus according to claim 1, wherein the traveler is connected with the mandrel element via a mandrel bar.

12. The apparatus according to claim 9, wherein the mandrel element can be moved during the bending process in the workpiece in at least one of a reversing manner and a rotation about its longitudinal axis.

13. The apparatus according to claim 1, wherein the magnetic device is coaxially arranged with respect to the traveler and the radial gap therebetween is advantageously chosen to be so small between the two that the workpiece is snugly fit therein.

* * * * *